US007866781B2

(12) United States Patent
Kim et al.

(10) Patent No.: US 7,866,781 B2
(45) Date of Patent: Jan. 11, 2011

(54) METHOD AND APPARATUS TO CHECK PIEZOELECTRIC INKJET HEAD

(75) Inventors: Woo-sik Kim, Suwon-si (KR); Kye-si Kwon, Seoul (KR); Seong-jin Kim, Seongnam-si (KR); Seung-joo Shin, Seoul (KR); Byung-Hun Kim, Suwon-si (KR); Sang-il Kim, Suwon-si (KR)

(73) Assignee: Samsung Electro-Mechanics Co., Ltd, Suwon-si (KR)

( * ) Notice: Subject to any disclaimer, the term of this patent is extended or adjusted under 35 U.S.C. 154(b) by 688 days.

(21) Appl. No.: 11/775,295

(22) Filed: Jul. 10, 2007

(65) Prior Publication Data

US 2008/0136859 A1 Jun. 12, 2008

(30) Foreign Application Priority Data

Dec. 11, 2006 (KR) ..... 10-2006-0125661

(51) Int. Cl.
*B41J 29/393* (2006.01)

(52) U.S. Cl. ..... 347/19

(58) Field of Classification Search ..... 347/19
See application file for complete search history.

(56) References Cited

U.S. PATENT DOCUMENTS

| | | | | |
|---|---|---|---|---|
| 4,498,088 | A * | 2/1985 | Kanayama | 347/92 |
| 6,469,418 | B1 * | 10/2002 | Katerberg et al. | 310/316.01 |
| 2006/0038858 | A1 * | 2/2006 | Ishizaki | 347/68 |

* cited by examiner

*Primary Examiner*—Julian D Huffman
(74) *Attorney, Agent, or Firm*—Stanzione & Kim, LLP

(57) ABSTRACT

A method and apparatus to check an operation of a piezoelectric inkjet head includes a first current detection unit to detect a first current output from a piezoelectric element of the piezoelectric inkjet head when a predetermined voltage is applied, a second current detection unit to detect a second current from a capacitor having a capacitance with the same magnitude as a capacitor component of the piezoelectric element when the voltage is applied to the capacitor, and a third current detection unit to detect a third current corresponding to a difference between the first current and the second current, as the amount of deformation of the piezoelectric element according to the application of the voltage.

7 Claims, 6 Drawing Sheets

$$I = I_p + I_c$$

$$I_p = \kappa \frac{dq}{dt}$$

$$I_c = C_p \frac{dV}{dt}$$

METHOD AND APPARATUS TO CHECK PIEZOELECTRIC INKJET HEAD

CROSS-REFERENCE TO RELATED APPLICATIONS

This application claims the benefit of Korean Patent Application No. 10-2006-00125661, filed on Dec. 11, 2006, in the Korean Intellectual Property Office, the disclosure of which is incorporated herein in its entirety by reference.

BACKGROUND OF THE INVENTION

1. Field of the Invention

The present general inventive concept relates to a piezoelectric Inkjet printer, and more particularly, to a method and apparatus to check a state of a piezoelectric inkjet head, by which information corresponding to an amount of deformation of a piezoelectric element included in the piezoelectric inkjet head can be easily obtained.

2. Description of the Related Art

Inkjet printers are widely used to form or print data or image on a print medium. Such Inkjet printers print images by spraying ink drops on demand. Printers having piezoelectric inkjet heads among the inkjet printers include a piezoelectric element in an ink chamber. The piezoelectric inkjet heads jet ink through nozzles according to characteristics of the piezoelectric element that is deformed when a voltage is applied thereto. Piezoelectric printing technology can very finely control the spraying of ink by adjusting a voltage applied to a piezoelectric element.

It is necessary to determine whether the piezoelectric inkjet head operates properly during manufacturing or using a printer having the piezoelectric Inkjet head. For example, a jetting state of ink drops is directly measured by photographing the ink drops jetted from nozzles or indirectly measured by measuring the displacement of the piezoelectric element using a laser vibrometer. Accordingly, conventional printers having piezoelectric Inkjet heads require special equipment in order to check the operations of piezoelectric Inkjet heads.

SUMMARY OF THE INVENTION

The present general inventive concept provides a method and apparatus to check a state of a piezoelectric inkjet head, in which information corresponding to an amount of deformation of a piezoelectric element included in the piezoelectric inkjet head can be easily obtained without expensive or separate equipment is included.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing an apparatus to check a state of a piezoelectric inkjet head, the apparatus including a first current detection unit to detect a first current output from a piezoelectric element of the piezoelectric inkjet head when a predetermined voltage is applied, a second current detection unit to detect a second current from a capacitor having a capacitance with the same magnitude as a capacitor component of the piezoelectric element when the voltage is applied to the capacitor, and a third current detection unit to detect a third current corresponding to a difference between the first current and the second current, as an amount of deformation of the piezoelectric element according to the application of the voltage.

The foregoing and/or other aspects and utilities of the present general inventive concept may also be achieved by providing a method of checking a state of a piezoelectric inkjet head, the method including detecting a first current output from a piezoelectric element of the piezoelectric inkjet head when a predetermined voltage is applied; detecting a second current from a capacitor having a capacitance with the same magnitude as a capacitor component of the piezoelectric element when the voltage is applied to the capacitor, and detecting a third current corresponding to a difference between the first current and the second current, as an amount of deformation of the piezoelectric element according to the application of the voltage.

The foregoing and/or other aspects and utilities of the present general inventive concept may also be achieved by providing an apparatus to check an operation of a piezoelectric inkjet head, the apparatus including a detecting unit to determine a state of a piezoelectric inkjet head according to a first current corresponding to a voltage applied to the piezoelectric inkjet head and a second current corresponding to a capacitance of the piezoelectric inkjet head.

The detecting unit may detect the first current output from a piezoelectric element of the piezoelectric inkjet head when the voltage is applied, detects the second current from a capacitor having a capacitance with the same magnitude as a capacitor component of the piezoelectric element when the voltage is applied to the capacitor, and detects a third current corresponding to a difference between the first current and the second current, as an amount of deformation of the piezoelectric element according to the application of the voltage.

The detecting unit may include a first current detection unit to detect the first current output from a piezoelectric element of the piezoelectric inkjet head when the voltage is applied, a second current detection unit to detect the second current from a capacitor having a capacitance with the same magnitude as a capacitor component of the piezoelectric element when the voltage is applied to the capacitor, and a third current detection unit to detect a third current corresponding to a difference between the first current and the second current, as an amount of deformation of the piezoelectric element according to the application of the voltage The voltage may include a first voltage and a second voltage to be applied to a piezoelectric element of the piezoelectric inkjet head during a first period and a second period, respectively, and the detecting unit may detect the first current and the second current during one of the first period and the second period.

The apparatus may further include an adjusting unit to adjust a gain of one of the first current and the second current, and the state of a piezoelectric inkjet head is determined according to the gain adjusted current.

The detecting unit may determine the state of the piezoelectric inkjet head according to the first current, the second current, and a reference current.

The state of a piezoelectric inkjet head may include an amount of deformation of a piezoelectric element of the piezoelectric inkjet head.

The piezoelectric element of the piezoelectric inkjet head may include an upper electrode, a piezoelectric film, and a lower electrode, and the state of the piezoelectric inkjet head may include the amount of deformation of the piezoelectric film of the piezoelectric element of the piezoelectric inkjet head.

The piezoelectric inkjet head may include a piezoelectric element having an upper electrode, a piezoelectric film, and a lower electrode to form a capacitor with the upper electrode, and the detecting unit may detect the first current flowing through the upper electrode, the piezoelectric film, and the lower electrode, and the second current from the capacitor.

The apparatus may include a driver to drive the piezoelectric inkjet head with the voltage, and the detecting unit may detect the first current and the second voltage between the driver and a piezoelectric element of the piezoelectric inkjet head according to the application of the voltage.

The foregoing and/or other aspects and utilities of the present general inventive concept may also be achieved by providing a method of checking an operation of a piezoelectric inkjet head, the method including determining a state of a piezoelectric inkjet head according to a current corresponding to a voltage applied to the piezoelectric inkjet head and a current corresponding to a capacitance of the piezoelectric inkjet head.

The foregoing and/or other aspects and utilities of the present general inventive concept may also be achieved by providing an apparatus to check an operation of a piezoelectric inkjet head, the apparatus including a detecting unit to determine a state of a piezoelectric inkjet head according to at least two current patterns corresponding to a voltage applied to the piezoelectric inkjet head.

The foregoing and/or other aspects and utilities of the present general inventive concept may also be achieved by providing a method of checking an operation of a piezoelectric inkjet head, the method including determining a state of a piezoelectric inkjet head according to at least two current patterns corresponding to a voltage applied to the piezoelectric inkjet head.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
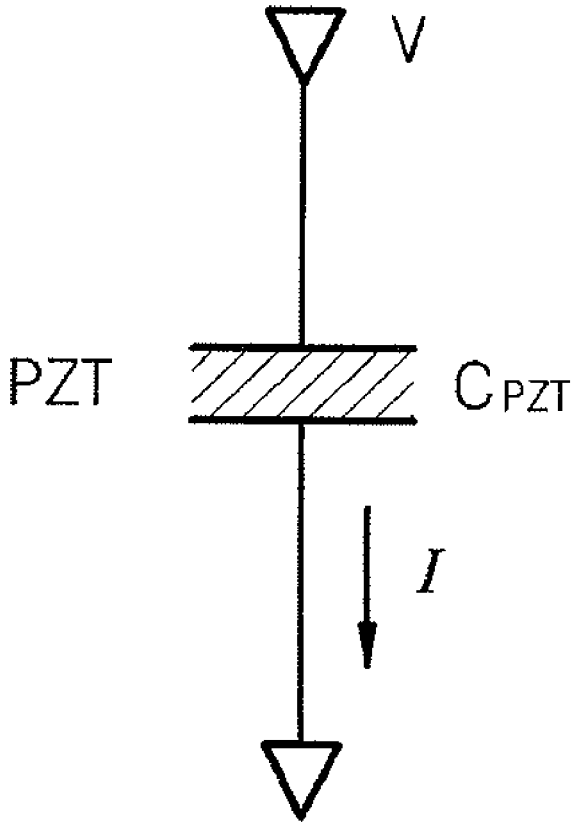
FIG. 1 illustrates characteristics of a piezoelectric inkjet head according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 illustrates one or more characteristics of a piezoelectric inkjet head according to an embodiment of the present general inventive concept. The piezoelectric inkjet head can be used in an image forming apparatus to form an image on a printing medium or print the printing medium with ink. The image forming apparatus may include a feeding unit to control a relative movement between the piezoelectric inkjet head and the printing medium to a printing position, a driving unit to drive the piezoelectric inkjet head to perform a printing operation or an ink ejecting operation on the printing medium disposed in the printing position, and a control unit to control the feeding unit and the driving unit. The control unit may perform a checking operation to check a state of the piezoelectric inkjet head.

Referring to FIG. 1, a piezoelectric element PZT of the piezoelectric inkjet head has a capacitor component CPZT. When a voltage V is applied to the piezoelectric element PZT, a current I is output or flows through the piezoelectric element PZT according to the applied voltage V of the piezoelectric element PZT. The current I can include a current Ic ($=Cp\times dV/dt$), which is generated by a capacitor component CPZT of the piezoelectric element PZT, and a current Ip ($=k\times dq/dt$) corresponding to an amount of deformation of the piezoelectric element PZT caused by vibration of the piezoelectric element PZT according to the application of the voltage V. Here, Cp denotes a constant corresponding to a capacitance of the capacitor component CPZT of the piezoelectric element PZT. In the current Ip ($=k\times dq/dt$), q denotes an amount of charges that are accumulated in the piezoelectric element PZT in proportion to the amount of deformation of the piezoelectric element PZT caused by vibration of the piezoelectric element PZT, and k denotes a constant. Therefore, in the present general inventive concept, a current corresponding to the amount of deformation of a piezoelectric element caused by vibration of the piezoelectric element is obtained by subtracting a current generated by a capacitor component of the piezoelectric element from a current that is generated when a voltage is applied to the piezoelectric element.

Here, the current Ic can flow through the capacitor component CPZT of the piezoelectric element PZT and can be used to charge the capacitor component CPZT as a capacitor of the piezoelectric element PZT. The capacitor component CPZT may be a capacitor included in a circuit of the piezoelectric head to drive the piezoelectric element PZT. Accordingly, the capacitor component CPZT of the piezoelectric element PZT as a capacitor can be charged during the printing or ejecting operation according to the constant Cp of the capacitor component CPZT and the voltage V.

The current Ip can flow through the piezoelectric element PZT and can be used to deform or vibrate the piezoelectric element PZT to change a volume of an ink chamber and to eject the ink of the ink chamber through a corresponding nozzle of the piezoelectric inkjet head.

Accordingly, the current I can be a sum of the current Ic and the current Ip which are used to charge and deform the piezoelectric element PZT of the piezoelectric inkjet head, respectively, during the printing or ejecting operation of the piezoelectric inkjet head.

Figure 2:
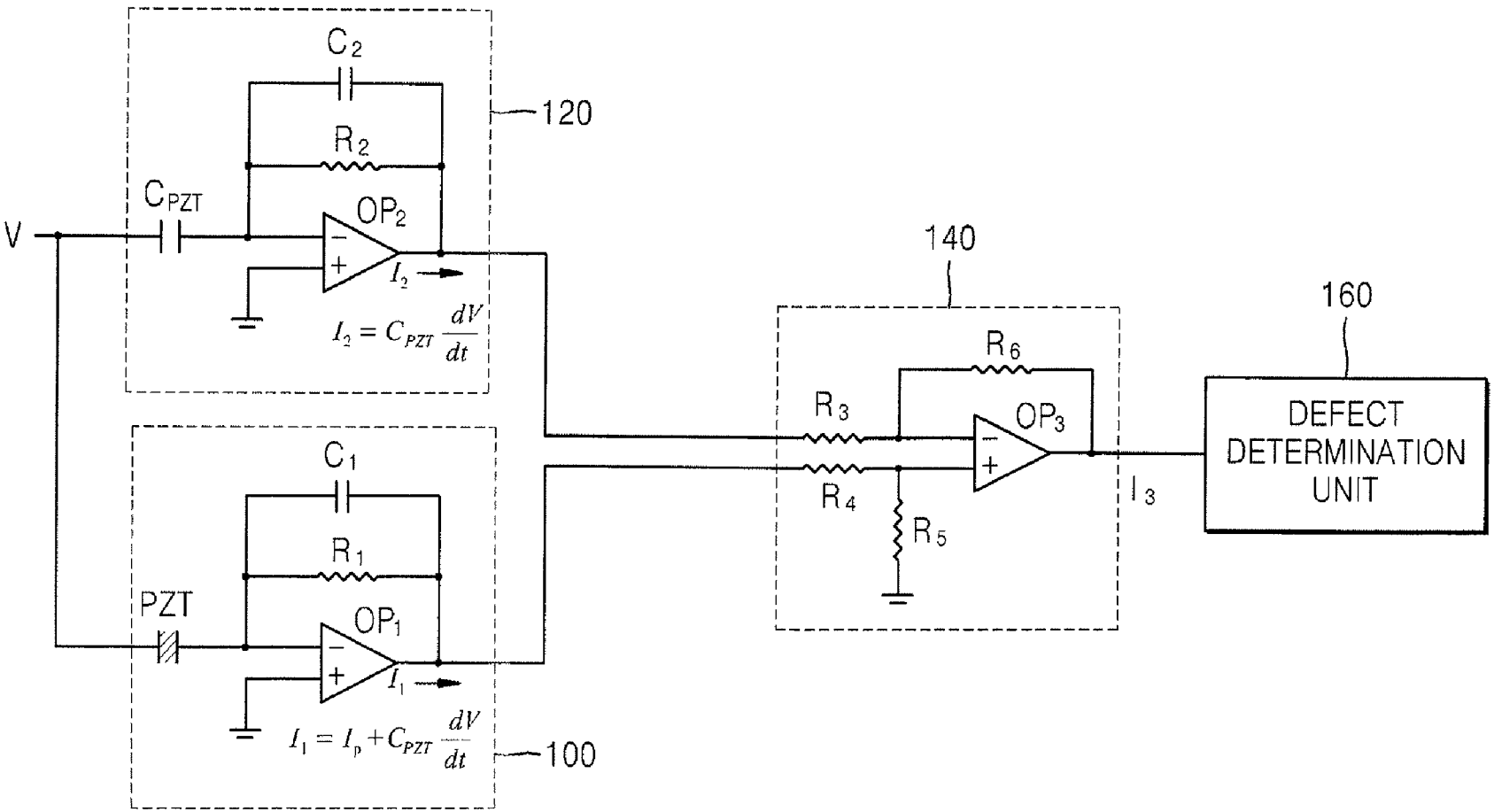
FIG. 2 is a circuit diagram illustrating an apparatus to check a state of a piezoelectric inkjet head, according to an embodiment of the present general inventive concept.

FIG. 2 is a circuit diagram illustrating an apparatus to check a state of a piezoelectric inkjet head according to an embodiment of the present general inventive concept. Referring to FIG. 2, the apparatus to detect a state of a piezoelectric inkjet head includes a first current detection unit 100, a second current detection unit 120, a third current detection unit 140, and a defect determination unit 160.

The state of the piezoelectric inkjet head may be an operation of the piezoelectric inkjet head, for example, a printing operation, an ink ejecting operation, or a driving operation of the piezoelectric inkjet head to eject ink toward a printing medium through a corresponding nozzle of the piezoelectric inkjet head to form an image on the printing medium or print the printing medium with the ink.

The first current detection unit 100 detects a first current $I_1$ that is output from a piezoelectric element PZT of the piezoelectric inkjet head according to the application of a predetermined voltage V, and outputs the first current $I_1$ to the third current detection unit 140. The first current detection unit 100 includes an operational (OP) amplifier OP1, a resistor R1, and a capacitor C1.

The first current $I_1$ includes a current Ic (=CPZT×dV/dt), which is generated by a capacitor component CPZT of the piezoelectric element PZT upon the application of the predetermined voltage V, and a current Ip (=k×dq/dt), which is a current corresponding to an amount of deformation of the piezoelectric element PZT caused by vibration of the piezoelectric element PZT according to the application of the voltage V. In the current Ip (=k×dq/dt), q denotes an amount of charges that are accumulated in the piezoelectric element PZT in proportion to the amount of deformation of the piezoelectric element PZT so as to change a volume of the ink chamber and to eject the ink through the corresponding nozzle of the piezoelectric inkjet head.

The second current detection unit 120 detects a second current $I_2$ from the capacitor CPZT having a capacitance with the same magnitude as the capacitor component of the piezoelectric element PZT when the voltage V is applied to the capacitor CPZT, and outputs the second current $I_2$ to the third current detector 140. The second current detection unit 120 can include an OP amplifier OP2, a resistor R2, and a capacitor C2.

Since the capacitor CPZT has a capacitance with the same magnitude as the capacitor component of the piezoelectric element PZT, when the voltage V which is the same as the voltage V applied to the piezoelectric element PZT is applied to the capacitor CPZT, a current having the same magnitude as the current Ic (=CPZT×dV/dt) generated by the capacitor component CPZT of the piezoelectric element PZT is output as the second current $I_2$.

The third current detection unit 140 detects a third current $I_3$ corresponding to a difference between the first current $I_1$ and the second current $I_2$, as the amount of deformation of the piezoelectric element PZT according to the application of the voltage V, and outputs the third current I3 to the defect determination unit 160. The third current detection unit 140 can include an OP amplifier OP3, i.e., a differential amplifier, and resistors R3, R4, R5, and R6.

As illustrated in FIG. 2, the third current $I_3$ (=k×dq/dt) is obtained by subtracting the second current $I_2$=CPZT×dV/dt from the first current $I_1$=k×dq/dt+CPZT×dV/dt. The third current $I_3$ (=k×dq/dt) denotes information corresponding to the amount of deformation of the piezoelectric element PZT caused by vibration of the piezoelectric element PZT according to the application of the voltage V.

The defect determination unit 160 determines whether the piezoelectric inkjet head is defective, using the third current I3 detected by the third current detection unit 140. The defect determination unit 160 determines whether one or more ink drops are properly jetted through the nozzles of the piezoelectric inkjet head or whether the nozzles are physically defective, by using a variation in the third current $I_3$ caused after the application of the voltage V is concluded.

Figure 3:
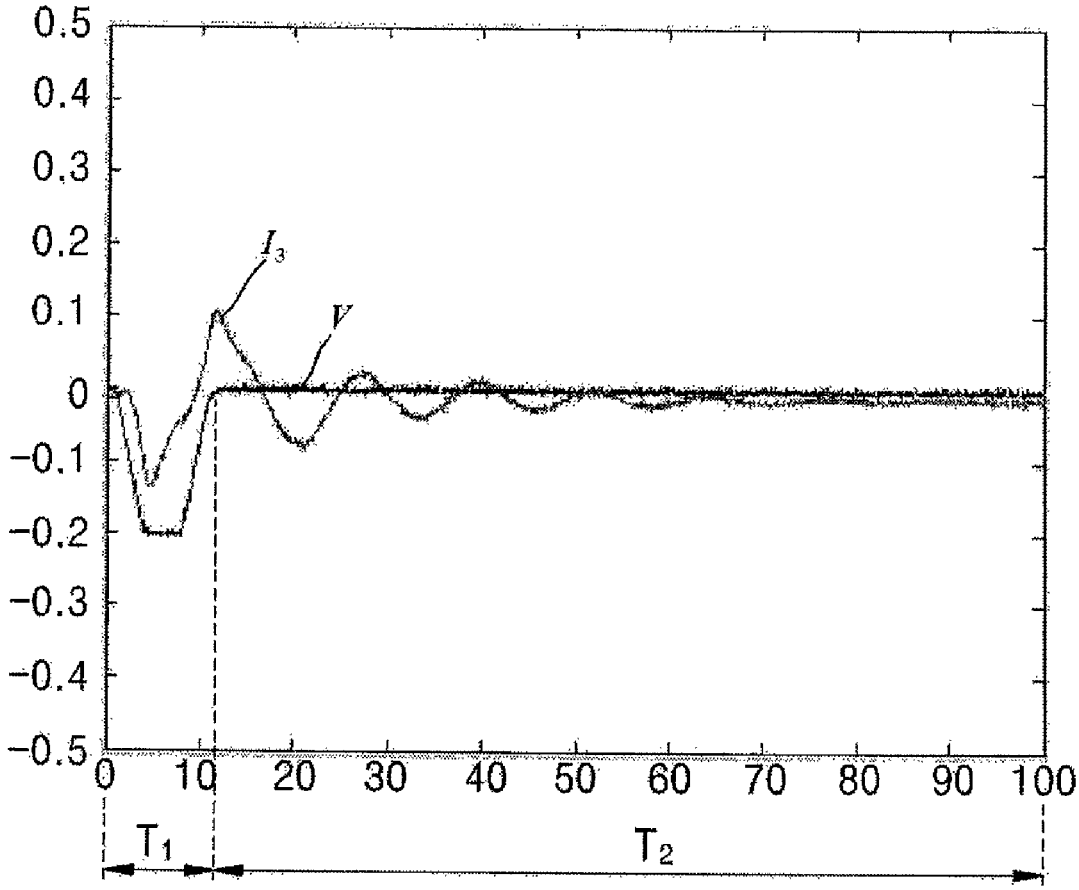
FIG. 3 is a graph illustrating a variation in current output according to an application of a voltage.

FIG. 3 is a graph illustrating a variation in the third current I3 output according to the application of the voltage V. As illustrated in FIG. 3, when the voltage V is applied to the piezoelectric element of the piezoelectric inkjet head during a period of time T1, the third current I3 is detected according to the voltage V. Even when the voltage V is not applied to the piezoelectric element of the piezoelectric inkjet head, the third current I3 varies during a period of time T2. The defect determination unit 160 can detect whether a comparative piezoelectric inkjet head is defective, by comparing a variation of a third current I3 of a normal piezoelectric inkjet head with a variation of a third current I3 of the comparative piezoelectric inkjet head.

Figure 4A:
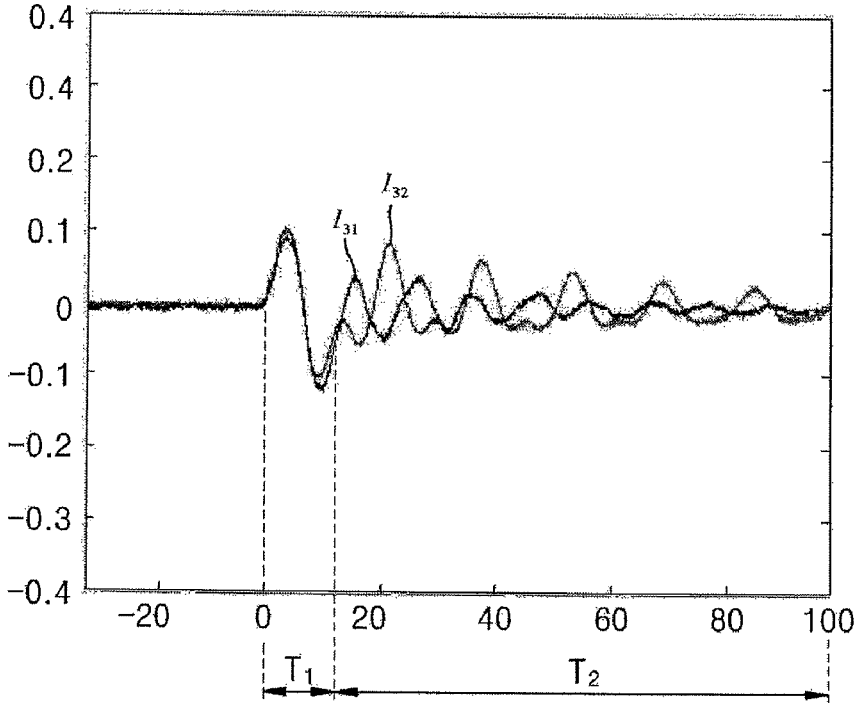
FIGS. 4A and 4B are graphs illustrating differences between currents according to the intrinsic vibration number of a piezoelectric element or damping thereof.
Figure 4B:
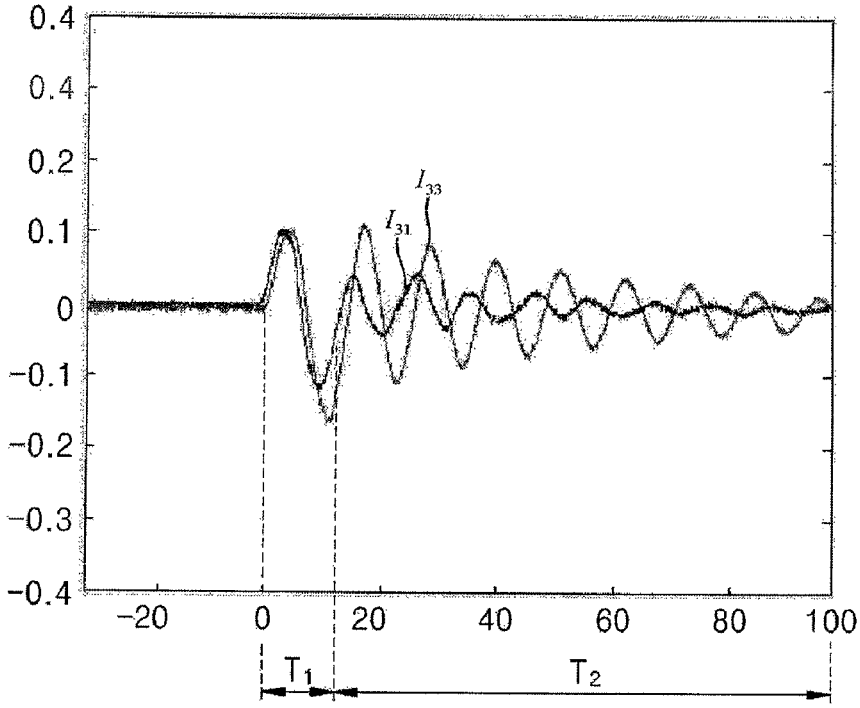

FIGS. 4A and 4B are graphs illustrating differences between third currents according to a natural frequency of a piezoelectric element and according to damping thereof. In FIG. 4A, a third current $I_{31}$ that is detected from a normal piezoelectric element during a period of time T1 when the voltage V is applied and during a period of time T2 starting after the application of the voltage V is terminated is compared with a third current $I_{32}$ that is detected from a piezoelectric element having an abnormal natural frequency during the period of time T1 and the period of time T2. As illustrated in FIG. 4A, when a piezoelectric element has an abnormal natural frequency, the third current $I_{32}$, which is abnormal and different from the third current $I_{31}$ detected from the normal piezoelectric element, is detected.

In FIG. 4B, the third current $I_{31}$ that is detected from the normal piezoelectric element during the period of time T1 when the voltage V is applied and during the period of time T2 starting after the application of the voltage V is terminated is compared with a third current $I_{33}$ that is detected from a piezoelectric element whose damping is abnormal during the period of time T1 and the period of time T2. As illustrated in FIG. 4B, when damping of a piezoelectric element is abnormal, the third current $I_{33}$, which is abnormal and different from the third current $I_{31}$ detected from the normal piezoelectric element, is detected.

As describe above, the defect determination unit 160 can determine whether ink drops are properly jetted through the nozzles of the piezoelectric inkjet head or the nozzles are physically defective, by comparing a third current of a normal piezoelectric element with that of a comparative piezoelectric element.

As describe above, a characteristic of one or more currents of the piezoelectric element can be detected to determine whether the piezoelectric element is normal or defective, or whether the ink droplets are properly ejected. The characteristic of the currents may be a pattern to be compared with a reference pattern during a period of applying a voltage and/or a period of terminating the application of the voltage. It is possible that the voltage can be changed between a first voltage and a second voltage to correspond to the application of a voltage and the termination of the application of the voltage, respectively.

Figure 5:
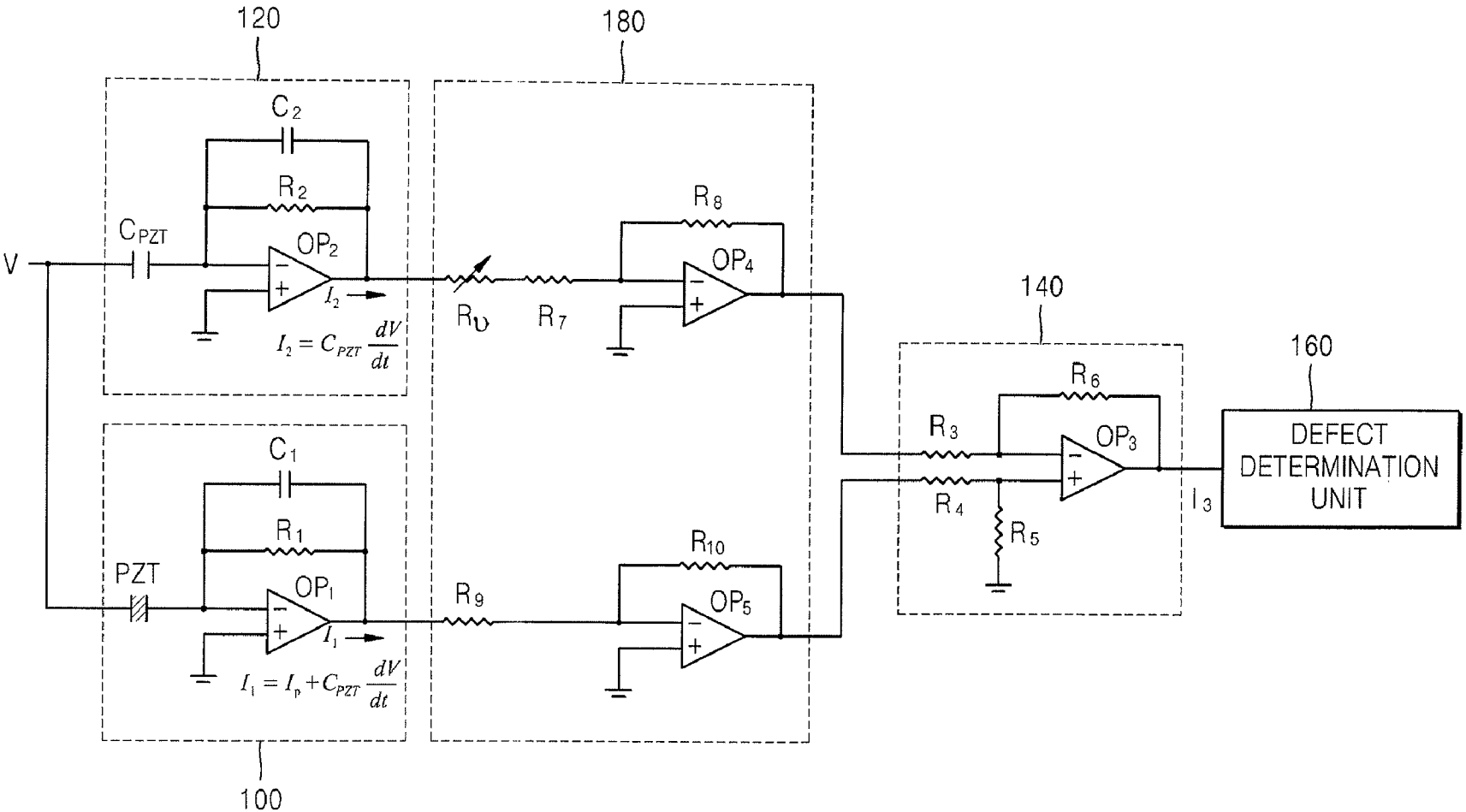
FIG. 5 is a circuit diagram illustrating an apparatus to check a state of a piezoelectric inkjet head, according to an embodiment of the present general inventive concept.

FIG. 5 is a circuit diagram illustrating an apparatus to check an operation of a piezoelectric inkjet head, according to an embodiment of the present general inventive concept. The apparatus of FIG. 5 further includes a gain adjusting unit 180 in addition to the components of the apparatus of FIG. 2. The reference numbers used for elements in FIG. 2 are also used for the same elements common to FIG. 5. Accordingly, the same elements will not be described again hereinafter and only the gain adjusting unit 180 will be described.

The gain adjusting unit 180 adjusts the gain of the second current I2 so that the second current I2 has the same value as the current Ic=CPZT×dV/dt output due to the capacitor component CPZT of the piezoelectric element PZT. Ideally, the capacitance of the capacitor CPZT included in the second current detector 120 has the same magnitude as the capacitance of the capacitor component CPZT of the piezoelectric element PZT. However, in practice, the capacitance of the capacitor CPZT included in the second current detector 120 may not have the same magnitude as the capacitance of the capacitor component CPZT of the piezoelectric element PZT. When the capacitance of the capacitor CPZT included in the second current detector 120 has a magnitude different from the capacitance of the capacitor component CPZT of the piezoelectric element PZT, the gain adjusting unit 180 adjusts the gain of the second current I2 output from the second current detector 120 so that the second current I2 is identical with the current IC output due to the capacitor component CPZT of the piezoelectric element PZT.

To achieve this function, as illustrated in FIG. 5, the gain adjusting unit 180 may include at least one OP amplifier, for example OP amplifiers OP4 and/or OP5, resistors R7, R8, R9, and R10, and at least one variable resistor RV. The variable resistor RV of the gain adjusting unit 180 is controlled so that the second current $I_2$ has the same value as the current Ic output due to the capacitor component CPZT of the piezoelectric element PZT.

According to the present embodiment, the piezoelectric inkjet head may have one or more substrates to define an ink chamber to contain ink and a nozzle through which the ink is ejected, and a piezoelectric element PZT to change a volume of the ink chamber to eject the contained ink to an outside thereof through the nozzle. The piezoelectric element PZT may include a lower electrode as a common electrode formed on a vibration plate of the substrate to be connected to a driver, a piezoelectric film formed on the lower electrode, and an upper electrode formed on the piezoelectric film to be connected to the driver. A conventional piezoelectric element can be used as the piezoelectric element PZT. The image forming apparatus may include a control unit to control the driver to apply the voltage V to the upper electrode and the lower electrode of the piezoelectric element PZT.

The capacitor component CPZT of the piezoelectric element PZT may be a capacitor formed between the upper electrode and the lower capacitor of the piezoelectric element PZT. It is possible that the capacitor component CPZT of the piezoelectric element PZT may be a capacitor connected in the driver and/or the piezoelectric element PZT along an electrical path (or line) to apply the voltage V to the piezoelectric element PZT.

Figure 6:
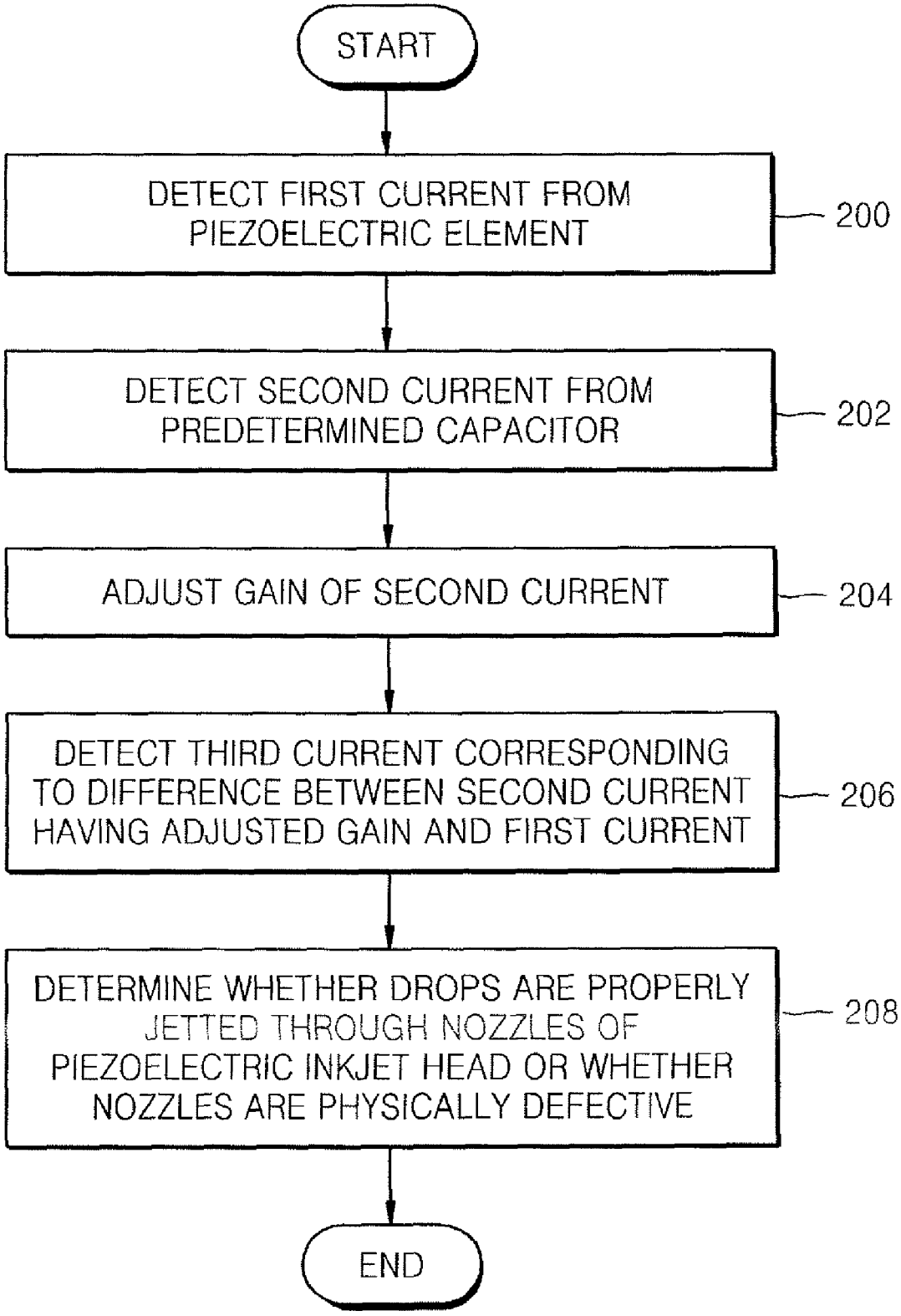
FIG. 6 is a flowchart illustrating a method of checking a state of a piezoelectric inkjet head, according to an embodiment of the present general inventive concept.

FIG. 6 is a flowchart illustrating a method of checking an operation of a piezoelectric inkjet head according to an embodiment of the present general inventive concept. Referring to FIGS. 1 through 6, in operation 200, the first current $I_1$ output from the piezoelectric element PZT of the piezoelectric inkjet head is detected as the voltage V is applied. The first current $I_1$ is detected using an OP amplifier. The first current $I_1$ includes a current Ic=CPZT×dV/dt generated by the capacitor component CPZT of the piezoelectric element PZT according to the application of the voltage V, and a current Ip=k×dq/dt corresponding to the amount of deformation caused by vibration of the piezoelectric element PZT according to the application of the voltage V. In the current IP=k×dq/dt, q denotes the amount of charges accumulated in the piezoelectric element PZT in proportion to the amount of deformation of the piezoelectric element PZT.

In operation 202, the voltage V is applied to a capacitor CPZT having the same magnitude of capacitance as that of the capacitor component CPZT of the piezoelectric element PZT, and the second current $I_2$ is accordingly detected from the capacitor CPZT. The second current $I_2$ is detected using another OP amplifier. Since the capacitor CPZT has the same magnitude of capacitance as that of the capacitor component CPZT of the piezoelectric element PZT, a current having the same magnitude as the current Ic=CPZT×dV/dt generated due to the capacitor component CPZT of the piezoelectric element PZT is output as the second current I2.

In operation 204, the gain of the second current $I_2$ may be adjusted so that the second current $I_2$ has the same value as the current Ic output due to the capacitor component CPZT of the piezoelectric element PZT. It is possible that the capacitance of the capacitor CPZT included in the second current detector 120 has the same magnitude as the capacitance of the capacitor component CPZT of the piezoelectric element PZT. However, the capacitance of the capacitor CPZT included in the second current detector 120 may not have the same magnitude as the capacitance of the capacitor component CPZT of the piezoelectric element PZT. When the capacitance of the capacitor CPZT included in the second current detector 120 has a magnitude different from the capacitance of the capacitor component CPZT of the piezoelectric element PZT, the gain of the second current $I_2$ is adjusted so that the second current $I_2$ is identical with the current IC output due to the capacitor component CPZT of the piezoelectric element PZT. To achieve this, by controlling a variable resistor of at least one OP amplifier, the gain of the second current $I_2$ is controlled so that the second current I2 has the same value as the current IC output due to the capacitor component CPZT of the piezoelectric element PZT. This gain adjusting operation is optional, so operation 202 may be followed by operation 206.

In operation 206, the third current $I_3$ corresponding to a difference between the first and second currents $I_1$ and $I_2$ is detected as the amount of deformation of the piezoelectric element PZT according to the application of the voltage V. The third current $I_3$ is detected using a differential amplifier.

The third current $I_3$ (=k×dq/dt) is obtained by subtracting the second current $I_2$=CPZT×dV/dt from the first current $I_1$=k×dq/dt+CPZT×dV/dt. The third current $I_3$(=k×dq/dt) denotes information corresponding to the amount of deformation of the piezoelectric element PZT according to the application of the voltage V.

In operation 208, it is determined using the third current $I_3$ whether the piezoelectric inkjet head is defective. More specifically, in operation 208, it is determined from a variation in the third current $I_3$ after the conclusion of the application of the voltage V whether drops are properly jetted through the nozzles of the piezoelectric inkjet head or whether the nozzles are physically defective.

For example, a detection as to whether a comparative piezoelectric inkjet head is defective is made by comparing a variation of a third current $I_3$ of a normal piezoelectric inkjet head with a variation of a third current $I_3$ of the comparative piezoelectric inkjet head.

In a method and apparatus to check an operation of a piezoelectric inkjet head according to the present general inventive concept, information corresponding to the amount of deformation of the piezoelectric inkjet head can be easily obtained by removing a current generated due to a pure capacitive component of the piezoelectric inkjet head from a current generated due to a voltage applied to the piezoelectric inkjet head.

The present general inventive concept can also be embodied as computer-readable codes on a computer-readable medium. The computer-readable medium can include a computer-readable recording medium and a computer-readable transmission medium. The computer-readable recording medium is any data storage device that can store data which can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

Accordingly, even when no expensive or separate equipment is included to determine whether the piezoelectric inkjet head properly operates, an operational state of the piezoelectric inkjet head can be monitored using a simple device for measuring a current. The monitored operation state of the piezoelectric inkjet head can be used as information for the maintenance of the piezoelectric inkjet head, Accordingly, information corresponding to the amount of deformation of the piezoelectric inkjet head is easily obtained by removing a current generated due to a pure capacitive component of the piezoelectric inkjet head from a current generated due to a voltage applied to the piezoelectric inkjet head. Therefore, an operational state of the piezoelectric inkjet head can be easily checked Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An apparatus to check an operation of a piezoelectric inkjet head, the apparatus comprising:

a first current detection unit to detect a first current output from a piezoelectric element of the piezoelectric inkjet head when a predetermined voltage is applied;

a second current detection unit to detect a second current from a capacitor having a capacitance with the same magnitude as a capacitor component of the piezoelectric element when the voltage is applied to the capacitor;

a third current detection unit to detect a third current corresponding to a difference between the first current and the second current, as an amount of deformation of the piezoelectric element according to the application of the voltage; and a gain adjusting unit adjusting a gain of the second current so that the second current has the same value as a current output due to the capacitor component of the piezoelectric element, wherein the gain adjusting unit comprises at least one OP amplifier having a variable resistor and controls the variable resistor so that the second current has the same value as the current output due to the capacitor component of the piezoelectric element.

2. A method of checking an operation of a piezoelectric inkjet head, the method comprising:

detecting a first current output from a piezoelectric element of the piezoelectric inkjet head when a predetermined voltage is applied;

detecting a second current from a capacitor having a capacitance with the same magnitude as a capacitor component of the piezoelectric element when the voltage is applied to the capacitor;

detecting a third current corresponding to a difference between the first current and the second current, as the amount of deformation of the piezoelectric element according to the application of the voltage; and adjusting a gain of the second current so that the second current has the same value as a current output due to the capacitor component of the piezoelectric element, wherein the adjusting of the gain comprises controlling a variable resistor included in at least one OP amplifier so that the second current has the same value as the current output due to the capacitor component of the piezoelectric element.

3. An apparatus to check an operation of a piezoelectric inkjet head, the apparatus comprising:

a first current detection unit to detect a first current output from a piezoelectric element of the piezoelectric inkjet head when a predetermined voltage is applied;

a second current detection unit to detect a second current from a capacitor having a capacitance with the same magnitude as a capacitor component of the piezoelectric element when the voltage is applied to the capacitor; and a third current detection unit to detect a third current corresponding to a difference between the first current and the second current, as an amount of deformation of the piezoelectric element according to the application of the voltage; and an adjusting unit to adjust a gain of one of the first current and the second current, wherein the state of a piezoelectric inkjet head is determined according to the gain adjusted current, wherein the voltage comprises a first voltage and a second voltage to be applied to a piezoelectric element of the piezoelectric inkjet head during a first period and a second period, respectively; and a detecting unit detects the first current and the second current during one of the first period and the second period, wherein the gain adjusting unit comprises at least one OP amplifier having a variable resistor and controls the variable resistor so that the second current has the same value as the current output due to the capacitor component of the piezoelectric element.

4. An apparatus to check an operation of a piezoelectric inkjet head, the apparatus comprising:

a first current detection unit to detect a first current output from a piezoelectric element of the piezoelectric inkjet head when a predetermined voltage is applied;

a second current detection unit to detect a second current from a capacitor having a capacitance with the same magnitude as a capacitor component of the piezoelectric element when the voltage is applied to the capacitor; and a third current detection unit to detect a third current corresponding to a difference between the first current and the second current, as an amount of deformation of the piezoelectric element according to the application of the voltage; and an adjusting unit to adjust a gain of one of the first current and the second current, wherein the state of a piezoelectric inkjet head is determined according to the gain adjusted current, and wherein a detecting unit determines the state of the piezoelectric inkjet head according to the first current, the second current, and a reference current, wherein the gain adjusting unit comprises at least one OP amplifier having a variable resistor and controls the variable resistor so that the second current has the same value as the current output due to the capacitor component of the piezoelectric element.

5. An apparatus to check an operation of a piezoelectric inkjet head, the apparatus comprising:, a first current detection unit to detect a first current output from a piezoelectric element of the piezoelectric inkjet head when a predetermined voltage is applied;

a second current detection unit to detect a second current from a capacitor having a capacitance with the same magnitude as a capacitor component of the piezoelectric element when the voltage is applied to the capacitor; and a third current detection unit to detect a third current corresponding to a difference between the first current and the second current, as an amount of deformation of the piezoelectric element according to the application of the voltage; and an adjusting unit to adjust a gain of one of the first current and the second current, wherein the state of a piezoelectric inkjet head is determined according to the gain adjusted current, and wherein the state of a piezoelectric inkjet head comprises an amount of deformation of a piezoelectric element of the piezoelectric inkjet head, wherein the gain adjusting unit comprises at least one OP amplifier having a variable resistor and controls the variable resistor so that the second current has the same value as the current output due to the capacitor component of the piezoelectric element.

6. An apparatus to check an operation of a piezoelectric inkjet head, the apparatus comprising:

a first current detection unit to detect a first current output from a piezoelectric element of the piezoelectric inkjet head when a predetermined voltage is applied;

a second current detection unit to detect a second current from a capacitor having a capacitance with the same magnitude as a capacitor component of the piezoelectric element when the voltage is applied to the capacitor; and a third current detection unit to detect a third current corresponding to a difference between the first current and the second current, as an amount of deformation of the piezoelectric element according to the application of the voltage; and an adjusting unit to adjust a gain of one of the first current and the second current, wherein the state of a piezoelectric inkjet head is determined according to the gain adjusted current, wherein the piezoelectric inkjet head comprises a piezoelectric element having an upper electrode, a piezoelectric film, and a lower electrode to form a capacitor with the upper electrode, and a detecting unit detects the first current flowing through the upper electrode, the piezoelectric film, and the lower electrode, and the second current from the capacitor, wherein the gain adjusting unit comprises at least one OP amplifier having a variable resistor and controls the variable resistor so that the second current has the same value as the current output due to the capacitor component of the piezoelectric element.

7. An apparatus to check an operation of a piezoelectric inkjet head, the apparatus comprising:

a first current detection unit to detect a first current output from a piezoelectric element of the piezoelectric inkjet head when a predetermined voltage is applied;

a second current detection unit to detect a second current from a capacitor having a capacitance with the same magnitude as a capacitor component of the piezoelectric element when the voltage is applied to the capacitor; and a third current detection unit to detect a third current corresponding to a difference between the first current and the second current, as an amount of deformation of the piezoelectric element according to the application of the voltage; and an adjusting unit to adjust a gain of one of the first current and the second current, a driver to drive the piezoelectric inkjet head with the voltage, wherein the state of a piezoelectric inkjet head is determined according to the gain adjusted current, and wherein a detecting unit detects the first current and the second current between the driver and a piezoelectric element of the piezoelectric inkjet head according to the application of the voltage, wherein the gain adjusting unit comprises at least one OP amplifier having a variable resistor and controls the variable resistor so that the second current has the same value as the current output due to the capacitor component of the piezoelectric element.

* * * * *